United States Patent [19]

Grutter

[11] 4,221,246

[45] Sep. 9, 1980

[54] FLOOR JOIST MACHINE

[76] Inventor: William G. Grutter, 611 Kingsbury N.W., Grand Rapids, Mich. 49504

[21] Appl. No.: 930,566

[22] Filed: Aug. 3, 1978

[51] Int. Cl.[3] ..... B27F 1/08

[52] U.S. Cl. ..... 144/198 R; 83/35; 83/417; 83/404.1; 83/435.1; 144/3 R; 144/245 R; 144/245 B; 144/326 R; 198/474; 198/486; 414/751; 414/225; 414/748; 414/783; 269/56

[58] Field of Search ..... 198/774, 474, 486; 414/225, 745, 750, 751, 748, 783; 144/1 R, 2 R, 3 R, 198, 203, 204, 133 R, 312, 326 R, 242 R, 245 R, 6, 133 A; 83/404, 404.1, 404.3, 409, 412, 409.1, 425, 425.1, 425.2, 425.3, 432, 435.1, 35, 417; 269/56

[56] References Cited

U.S. PATENT DOCUMENTS

| | | | |
|---|---|---|---|
| 753,688 | 3/1904 | Edwards | 144/198 R |
| 1,765,987 | 6/1930 | Marion | 144/203 |
| 2,840,223 | 6/1958 | Schoppe | 198/474 |
| 2,876,815 | 3/1959 | Rogers | 144/326 R |
| 3,416,643 | 12/1968 | Kotila | 269/56 X |
| 3,735,787 | 5/1973 | Siel | 83/425.2 |
| 3,812,951 | 5/1974 | Fullaway | 414/748 |
| 3,972,358 | 8/1976 | Kappler | 414/745 |
| 3,985,221 | 10/1976 | Weiders | 414/748 |
| 4,002,248 | 1/1977 | Moller | 414/745 |
| 4,003,462 | 1/1977 | Perrott | 414/748 |
| 4,022,094 | 5/1977 | Hetherington | 83/435.1 |
| 4,040,459 | 8/1977 | Bush, Jr. et al. | 83/425.2 |

*Primary Examiner*—W. Donald Bray
*Attorney, Agent, or Firm*—DeLio and Montgomery

[57] ABSTRACT

A machine for cutting tenon ends on logs to be used as floor joists, the machine including transfer devices for depositing each log on a pair of conveyor belts, cut-off saws for cutting the log ends to a fixed length, sets of parallel and angled saws for cutting tenons on both ends of the log, and delivery devices for removing the sawed logs from the conveyors.

6 Claims, 8 Drawing Figures

W
75
73
71
17
51
53
55
54
18
76
72
74
52
56
VII
VII
23
24
21
89
91
22
94
85
87
89
85
14
13
49
VI
VI
50
84
44
81
W
44
81
20
82
83
24
80
98
95
19
80
V
V
VIII
VIII
96
97
68
42
15
16
39
70
60
60
65
36
35
58
35
31
57
38
12
II
11
29
30
32
II
26
27
26
26
25
25
10
W
25

65
70
63'
W
66
16
69
50
44
64
63
39
38
12
60
62
IV
41
14
III
37
50
36
67
35
68
46
43

23
101
99
98
97
95
96
102
104
103

16
W
W
32
39
44
38
37
41
40
42
14
30
58
50
36
12
35
43

W
16
W
74
50
76
14
72
53
46
77

FLOOR JOIST MACHINE

This invention relates to a machine for cutting tenon ends on logs to be used as floor joists in buildings such as log homes, the machine including transfer devices for depositing each log on a pair of carriages, cut-off saws for cutting the log ends to a fixed length, sets of parallel and angled saws for cutting tenons on both ends of the log, and delivery devices for removing the sawed logs from the carriages.

In the preparation of structural units for use in building log homes special attention must be given to the floor joists. The floor joist ends require tenons which should be squared off on at least three sides, with bevel cuts adjoining each flat cut side. Opposite ends must be cut identically and in register with each other, and different lengths have to be provided for. At least seven cuts are required to form each tenon.

It is accordingly an object of the invention to provide a machine wherein complete tenons are formed on both ends of a log in a single pass.

It is a further object of the invention to provide means for precisely adjusting the alignment of each log on a pair of carriages and means for retaining the logs firmly in adjusted position as they are carried through the machine.

It is another object of the invention to provide two pairs of saw assemblies, the saws in a first pair being adapted to cut the end and two side surfaces on each end of the log and the saws in the other pair being adapted to cut four additional side surfaces on each end.

It is a still further object of the invention to provide means for rotating the log axially 90° after its passage by the first pair of saws.

It is yet another object of the invention to provide certain improvements in the form, construction and arrangement of the several parts whereby the above-named and other objects may effectively be attained.

The invention accordingly comprises the features of construction, combinations of elements, and arrangement of parts which will be exemplified in the constructions hereinafter set forth, and the scope of the invention will be indicated in the claims.

A practical embodiment of the invention is shown in the accompanying drawings wherein.

Figure 1:
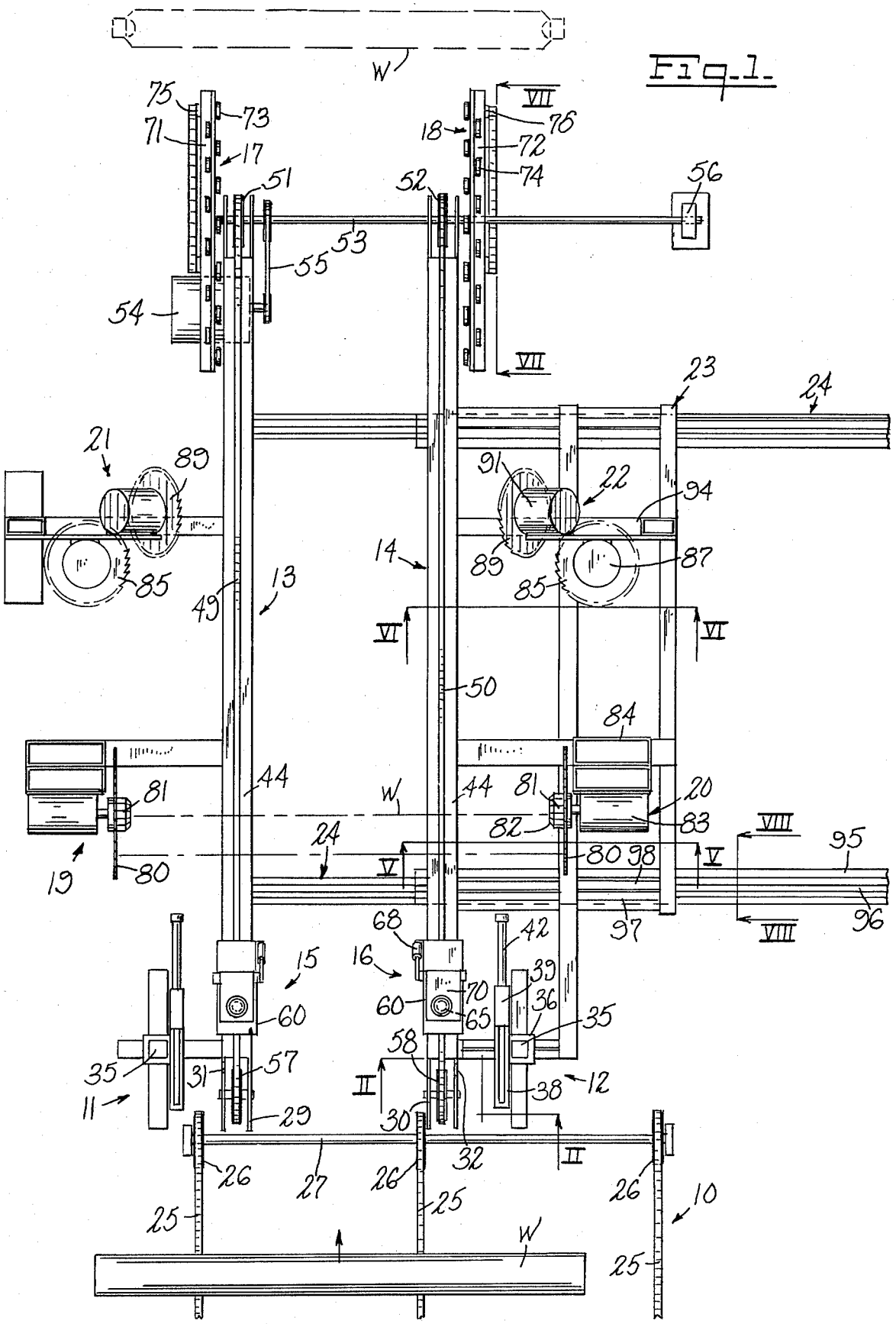
FIG. 1 represents a plan view of the complete machine.

Referring to the drawings, the machine is shown as comprising the log supply means 10, position adjusting assemblies 11, 12, tracks 13, 14, carriage and belt assemblies 15, 16, delivery assemblies 17, 18, first cutting assemblies 19, 20 and second cutting assemblies 21, 22.

Since floor joists may have to be cut to varying standard lengths, the machine is adjustable in that the elements 11, 13, 15, 17, 19 and 21 are mounted in fixed positions on the floor, while the corresponding elements 12, 14, 16, 18, 20, and 22 are carried, directly or indirectly, by the frame 23 which is laterally movable on tracks 24 by means to be described below.

The supply means 10 is conventional, in the form of suitably supported conveyor belts (chains) 25 on pulleys 26 carried by the shaft 27. The conveyor is adapted to deliver a workpiece (log) W to horizontal supports 29, 30 at the upstream end of the tracks, where it rests against stops 31, 32 until moved by the adjusting means.

The right and left hand assemblies 11–22 are symmetrical and comprise identical mechanical elements so that a description of one assembly in each pair will suffice. The terms "right" and "left" refer to parts as viewed in the direction of movement of the workpiece.

Figure 2:
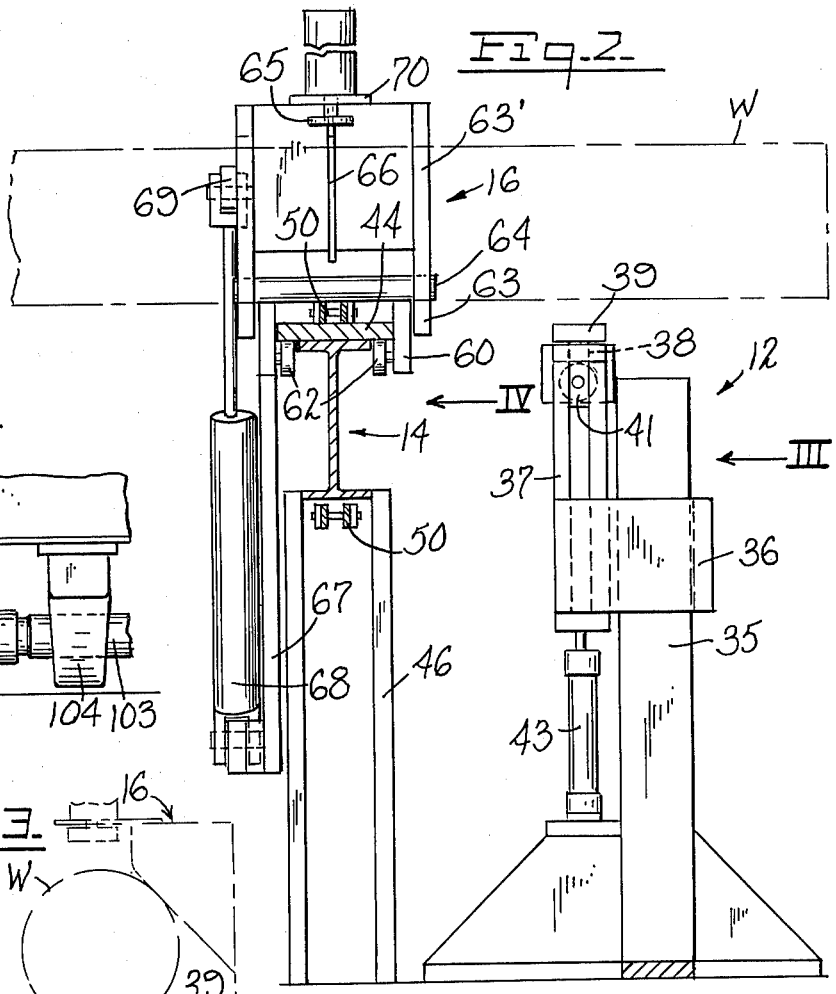
FIG. 2 represents a detail vertical section on the line II—II of FIG. 1.
Figure 3:
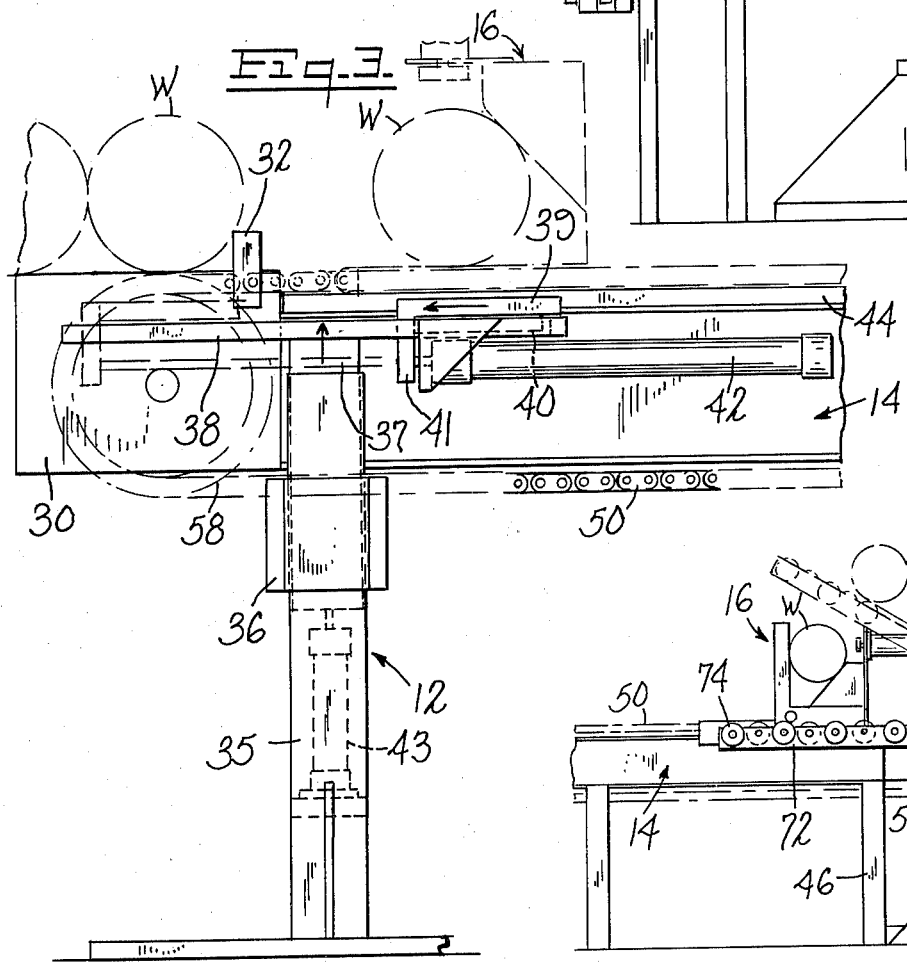
FIG. 3 represents a detail elevation from the direction of the arrow III in FIG. 2, parts being broken away and parts being shown in broken lines.

The adjusting assembly 12 (right), shown in FIGS. 2 and 3, comprises a supporting post 35, a guide 36 slidable on the post, a vertical stem 37 fixed to the guide 36 and a horizontal slotted track 38 mounted on the top of the stem. The shuttle cart 39 is slidable on the track where it is guided by the rib 40 on its bottom surface, fitting in the track slot, and an arm 41 projects through the slot to be engaged by the piston of a fluid actuated cylinder 42 for sliding the cart along the track. Another fluid actuated piston and cylinder 43 is located beneath the stem, guide track and cart. The fluid pressure hose lines for cylinders 42 and 43, and manual controls therefor are not shown. The left adjusting assembly 11 comprises elements of the same character; the controls are independent so that the respective shuttle carts can be actuated to line up each workpiece individually, as explained below.

The tracks 13 and 14 may suitably be in the nature of I-beams, surfaced upwardly by wear plates 44, the track 13 being supported on legs in a fixed position while the track 14 with its wear plate 44 is supported by legs 46 on the laterally movable frame 23.

The carriage and chain assemblies 15, 16 comprise link chains 49, 50 engaged, at the delivery end of the machine, by drive sprockets 51, 52 on the drive shaft 53 which is driven by reversible motor 54 through a drive chain 55. The sprocket 52 is keyed and movable on the shaft 53 and the latter is elongated and journaled in a bearing 56 to allow for lateral adjustment of frame 23 and the elements carried thereby. The upper run of each belt rests on a respective track wear plate and the belts pass around idler pulleys 57, 58 at the supply end of the machine.

Each log carriage is fastened to a respective chain and includes a truck 60 which is attached to the chain and is retained on the track by rolls 62 which are mounted on downwardly projecting flanges of the truck and bear against the under surface of the wear plate (FIG. 2). An L-shaped rocker 63 is pivotally mounted at 64 on the truck, the upwardly projecting leg 63' (FIG. 4) of the rocker being provided with a bracket 70 carrying a fluid actuated log clamps 65 and a generally triangular wedge plate 66 being fitted between the bracket and the upstanding leg. A frame 67 projects downwardly from one side of the truck and a fluid actuated cylinder and piston 68 are interposed between the bottom of the frame and a lug 69 on the leg 63' of the rocker.

The delivery assemblies 17, 18 comprise angle bars 71, 72 each provided with an array of rolls 73, 74 and pivotally mounted on a suitable support at 75, 76. Fluid actuated means such as the piston and cylinder 77 (FIG. 7) are adapted to tilt the roll bars upward for discharging the logs after sawing. The movable ends of the bars overlap substantially the delivery ends of the tracks, as clearly shown in FIGS. 1 and 7.

Each of the first cutting assemblies 19, 20 includes a composite saw having a circular portion 80, a cylindrical dado portion 81 and a beveled dado portion 82. The circular portion lies in a vertical plane, the surface of the cylindrical portion is perpendicular to the plane of the circular portion and the beveled portion forms a frusto-conical surface extending radially inward from the edge of the cylindrical portion. The composite saw is mounted on the horizontal drive shaft of a motor 83 supported on a stand 84 from the frame 23 (for assembly 20) or a similar fixed stand (for assembly 19). The horizonal spacing of the circular saws 80 in assemblies 19 and 20 determines the overall length of the cut log, as indicated in broken lines in FIG. 1.

Figure 6:
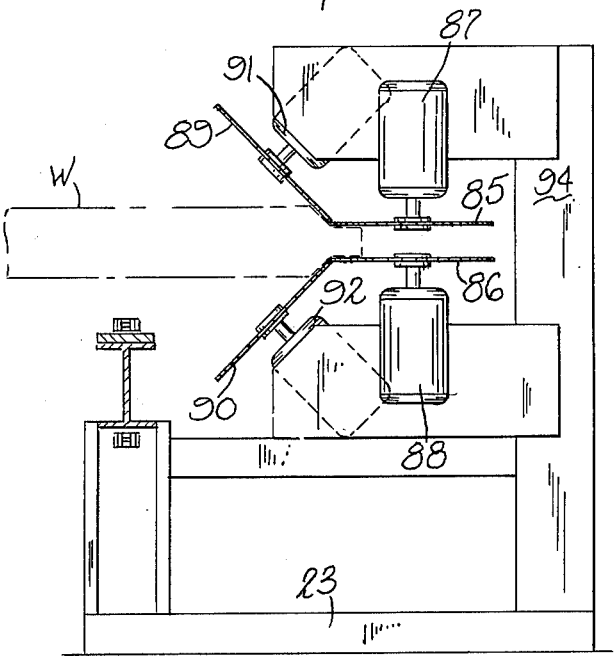
FIG. 6 represents a detail vertical section on the line VI—VI of FIG. 1.

Each of the second cutting assemblies 21, 22 (FIG. 6) includes a set of four circular saws, the upper and lower saws 85 and 86 being mounted on the vertically disposed coaxial drive shafts of motors 87 and 88 and thus lying in parallel horizontal planes, which are spaced by a distance corresponding to the desired thickness of the tenons to be formed on the log ends. The upper and lower saws 89 and 90 are mounted on the drive shafts of motors 91 and 92 at angles of 45° from the vertical (or horizontal), offset somewhat downstream from the saws 85 and 86, and so located that their cutting paths, when projected in the direction of travel of the logs, intersect the cutting paths of the respective upper and lower horizontal saws 85 and 86, as shown in FIG. 6. Each assembly of four saws and motors is supported on a stand 94 from the frame 23 (for the assembly 22) or in a similar fixed stand (for the assembly 21).

In operation, a workpiece W (log) is delivered by the conveyor belts 25 to the supports 29, 30 where it may rest against one or both of the stops 31, 32.

The shuttle carts 39 are moved (horizontal arrow in FIG. 3) to positions beneath the log and adjacent the opposite ends thereof. When thus positioned, the cart is raised by actuation of the piston and cylinder 43, lifting the log high enough to clear the stops 31, 32, and the carts are moved foward (by their pistons and cylinders 42) to introduce the log into the log carriages, then in the position shown in FIG. 4. The carts 39 can be moved independently, as needed, to line up the log on the flat leg of the rocker 63 in each carriage, against the wedge plates 66, and in a position to be clamped by the clamp 65, so that the log cannot roll or get out of line during the cutting operations.

All the saw motors are then started and the drive motor 54 is turned on to rotate shaft 53 and advance the carriages along the track.

Figure 5:
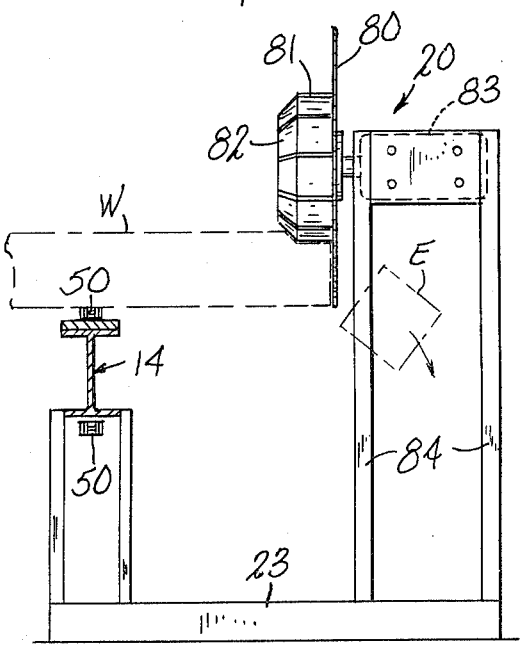
FIG. 5 represents a detail vertical section on the line V—V of FIG. 1.

At the first cutting station (FIG. 5) the saws 80 cut off the excess ends of the log (E in FIG. 5), the cylindrical dado head 81 forms a horizontal flattened surface parallel to the axis of the log, across the upper edge of the log and the beveled dado headforms a beveled surface adjacent the flat surface.

Figure 4:
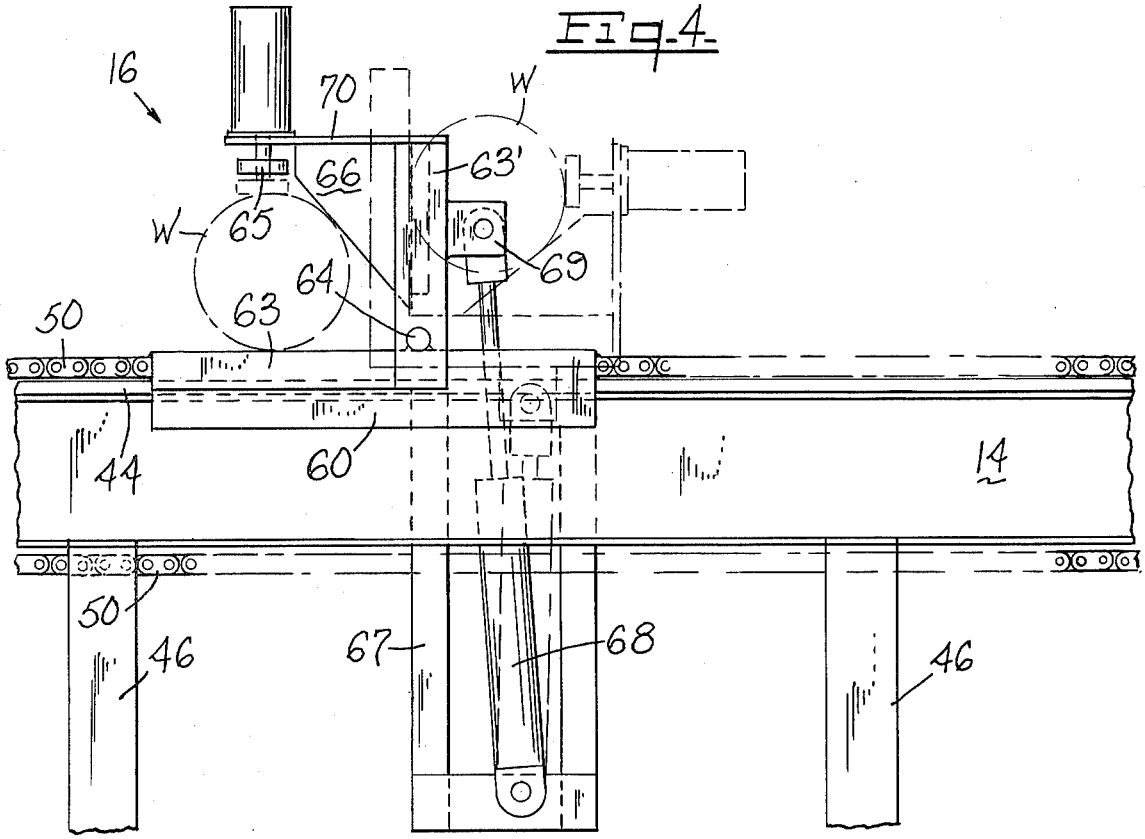
FIG. 4 represents a detail elevation from the direction of the arrow IV in FIG. 2, parts being broken away and parts being shown in broken lines.

Upon further advancement of the log, and before it reaches the second cutting station, the cylinders and piston 68 are actuated (preferably automatically) to pull downward on the lug 69 and thus rock the rocker 63 90° forward, as shown in broken lines in FIG. 4, to correspondingly rotate the log on its axis and bring the previously flattened surface into a vertical position. The log as thus adjusted encounters the four saws in each second cutting assembly 21, 22 and the saws 85, 86 make parallel horizontal cuts, defining the flat sides of the tenons, being immediately followed by the angled saws 89 and 90 which make bevel cuts intersecting the parallel cuts along straight lines and serving to remove the wood from each side of the tenons, as shown in FIG. 6.

Figure 7:
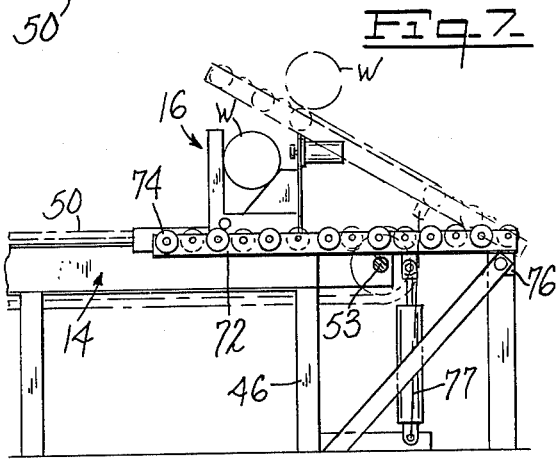
FIG. 7 represents a detail vertical section on the line VII—VII of FIG. 1.

With all cuts completed, the log approaches the delivery end of the track where it is stopped at the point shown in FIG. 7 and the clamps 65 are released. The pistons and cylinders 77 are actuated, raising the angle bars and lifting the log out of the carriages to roll down onto any suitable receiving rack (not shown) at the end of the machine, as indicated in broken lines in FIGS. 7 and 1.

When the finished log has been removed from the carriage, the motor 54 is reversed and the machine elements are returned to the positions shown in FIG. 1.

Figure 8:
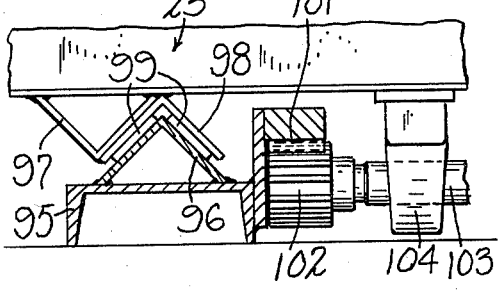
FIG. 8 represents a detail vertical section on the line VIII—VIII of FIG. 1.

The track arrangement, for lateral adjustment, is shown in FIG. 8 where a part of the frame is shown at 23. The track 24 includes a base 95 and an inverted angle-iron 96 welded thereto. The matching shoe on the frame is constituted by an angle-iron 97 welded to the underside of the frame elements and a downwardly facing angle-iron 98 partially supported by the angle-iron 97 and resting on the angle-iron 96 with the interposition of anti-friction strips 99 of a plastic such as nylon. Such anti-friction material, though not shown, may also be used to reduce friction in other parts of the machine as in the adjusting assemblies 11 and 12.

Coordinated lateral movement of both ends of the frame 23 may be assured by providing racks 101 on the track base elements 95, engaged by pinions 102 fixed on a bar 103 which is journaled in bearings 104 (only as being shown) fixed to the frame at spaced points adjacent respective track base elements.

The several fluid actuated means referred to above may be hydraulic or pneumatic, preferably the latter. The tubing for fluid supply is conventional and not shown. Cylinders on the moving carriages are supplied by helically coiled tubing, the coils of which stretch and contract as the carriages move from end to end. Controls for the motors and cylinders are most conveniently centralized in a console for operation by a single operator, except that the 90° rocking of the rocker on the carriage is preferably effected automatically.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

What I claim is:

1. A machine for cutting tenon ends on structural logs comprising, a conveyor adapted to transport a log laterally from a supply end to a delivery end, log supporting means on the conveyor, the log supporting means including a clamp, first and second pairs of oppositely located saw assemblies positioned at spaced points along the path of the conveyor in positions to cut substantially simultaneously the opposite ends of the log as the log is moved by the conveyor, means associated with the log supporting means for rotating the log 90° after its ends have been cut by the first pair of saw assemblies and before reaching the second pair of saw assemblies, and driving means for the conveyor and for the saw assemblies.

2. A machine according to claim 1 wherein the first pair of saw assemblies comprises saw elements adapted to cut both ends off the log.

3. A machine according to claim 2 wherein the first pair of saw assemblies includes dado saw elements adapted to form flat cut surfaces adjacent the cut ends of the log.

4. A machine according to claim 2 wherein the second pair of saw assemblies comprises saw elements adapted to form parallel flat cut surfaces adjacent the cut ends of the log and saw elements adapted to form angled cuts intersecting said flat cut surfaces.

5. A machine according to claim 4 wherein said angled cuts lie at angles of approximately 45° from the longitudinal axis of the log.

6. A machine according to claim 1 wherein the log supporting means includes a carriage portion connected to the conveyor, a rocker portion hingedly connected to the carriage portion and means for rocking the rocker portion through 90°, the clamp and its actuating means being mounted on the rocker portion.

* * * * *